US006109026A

United States Patent [19]

Karlsson et al.

[11] Patent Number: 6,109,026

[45] Date of Patent: Aug. 29, 2000

[54] MUFFLER WITH CATALYTIC CONVERTER

[75] Inventors: Egon Karlsson, Jönköping; Ulf Svensson, Lerum, both of Sweden

[73] Assignee: Aktiebolaget Electrolux, Stockholm, Sweden

[21] Appl. No.: 08/981,717

[22] PCT Filed: Jun. 19, 1996

[86] PCT No.: PCT/SE96/00805

§ 371 Date: Dec. 19, 1997

§ 102(e) Date: Dec. 19, 1997

[87] PCT Pub. No.: WO97/01023

PCT Pub. Date: Jan. 9, 1997

[30] Foreign Application Priority Data

Jun. 22, 1995 [SE] Sweden ..... 9502309

[51] Int. Cl.[7] ..... F01N 3/10

[52] U.S. Cl. ..... 60/302; 60/299; 60/314; 181/213; 181/240; 181/258

[58] Field of Search ..... 60/299, 301, 302, 60/323, 312, 314, 322; 181/230, 240, 258, 213, 219, 231

[56] References Cited

U.S. PATENT DOCUMENTS

| | | | |
|---|---|---|---|
| 4,890,690 | 1/1990 | Fischer et al. . | |
| 4,894,987 | 1/1990 | Harwood et al. | 60/299 |
| 5,021,388 | 6/1991 | Fridez et al. | 502/261 |
| 5,043,147 | 8/1991 | Knight | 422/180 |
| 5,110,690 | 5/1992 | Usui et al. | 428/678 |
| 5,139,107 | 8/1992 | Nagai | 181/240 |
| 5,206,467 | 4/1993 | Nagai et al. . | |
| 5,315,075 | 5/1994 | Junginger et al. | 181/240 |
| 5,373,119 | 12/1994 | Suzuki et al. | 181/230 |
| 5,386,696 | 2/1995 | Prigent et al. | 60/300 |
| 5,459,119 | 10/1995 | Abe et al. | 502/326 |
| 5,477,014 | 12/1995 | Dunne et al. | 181/244 |

FOREIGN PATENT DOCUMENTS

473081 A1 3/1992 European Pat. Off. .

*Primary Examiner*—Thomas Denion
*Assistant Examiner*—Binh Tran
*Attorney, Agent, or Firm*—Pearne & Gordon LLP

[57] ABSTRACT

Muffler with catalytic converter (1) essentially arranged in direct connection with a combustion engine's exhaust port and especially intended for portable working tools such as chain saws. At least one partition (2) is embodied in the muffler, or instance in the form of a baffle (3), and the partition (2) comprises one or several apertures (9, 10), through which the exhaust flow passes in order to flow from one side of the partition to the other side, and the partition is at least partly coated with a catalyzing layer.

20 Claims, 4 Drawing Sheets

MUFFLER WITH CATALYTIC CONVERTER

TECHNICAL FIELD

The subject invention refers to a muffler with catalytic converter arranged basically in direct proximity to an exhaust port of a combustion engine and mainly intended for portable power equipment such as chain saws.

BACKGROUND OF THE INVENTION

Mufflers with catalytic converters for combustion engines are well-known since a very long time, especially for cars. For portable power equipment, such as chain saws, they have been available on the market to a small extent since the end of the 1980's. Demands for low weight, size and cost have contributed towards the fact that catalytic converter technology was put into practice considerably later within this field. The catalytic mufflers, which have been used for portable equipment, have as a rule consisted of a converter element comprising coated, thin sheet metal strips. A pleated or corrugated metal strip can for instance be rolled together with a plane strip into a cylindrical element. Both strips are coated with a catalyzing layer, and the exhaust emissions are conducted through the axial cavities, which are formed between the strips, and are hereby cleaned. The catalytic converter element is relatively sensitive to vibrations and demands an elaborately designed mounting in order to get an acceptable length of life, seen from a purely mechanical point of view. The mounting itself demands additional details in the muffler, for instance a sleeve, which shall serve as an enclosure of the element. Furthermore, the muffler must be designed so that the catalytic converter element functions as a passage in the muffler, for instance located in an exhaust pipe out of the muffler. This implies certain restrictions for the muffler, since it is hardly reasonable from a cost point of view to use several smaller catalytic elements, which serve as parallel passages in the muffler. Thus, the usage of a converter element implies certain restrictions when designing the muffler, and this could bring about a reduced silencing effect. Both the converter element itself and its mounting are relatively costly, and this brings about a considerably more expensive muffler in total. When the converter element is used in a muffler for two-stroke engines, problems can also arise with a very high temperature in the converter element. This is due to the fact that the exhaust gases from the two-stroke engine contain a high content of unburned hydrocarbons, which are burned in the converter element. This partly leads to a very high heat generation in the converter element and partly to very hot exhaust gases. The converter element often reaches temperatures exceeding 1000 degrees C and must therefore be cooled down, for instance by means of heat dissipation. This must take place without the muffler's casing overheating anywhere, considering user-safety and legal requirements. The local heat generation in the converter element is consequently a problem.

PURPOSE OF THE INVENTION

The purpose of the subject invention is to substantially reduce the above outlined problems by creating a muffler with a catalytic converter, which achieves an effective reduction of the exhaust emissions without using a conventional converter element.

SUMMARY OF THE INVENTION

The above mentioned purpose is achieved in a muffler with catalytic converter in accordance with the invention having the characteristics appearing from the appended claims.

The muffler with catalytic converter in accordance with the invention thus is essentially characterized in that at least one partition is embodied in the muffler in the shape of for instance a baffle or an inlet or outlet tube, and the partition is designed with one or several openings through which the exhaust gas flow passes in order to flow from one side of the partition to the other, and the partition is at least partly coated with a catalyzing layer. That implies that a number of partitions are embodied in the muffler and the exhaust gases pass each partition respectively through apertures. A baffle with a large number of holes can for instance be located in the muffler. The baffle is coated with a catalyzing layer and the exhaust gases are cleaned when they come into contact with the baffle. This occurs to a particularly great extent in the area around each hole, when the exhaust gases pass through each hole respectively. Thereby the heat generation takes place in a number of different places in the muffler, and this makes it easier to conduct the heat to the muffler's casing in an even and controlled way. The muffler can be supplied with several different partitions, and this further increases the possibility of dissipating the heat in an even and controlled manner. Furthermore, the partitions can be designed in an effective way from a noise reduction point of view. The partition parts are simple and inexpensive to produce at the same time as they are mechanically durable and easy to mount in the muffler. The baffle can also be made from several details so that a number of cavities are formed in the baffle and hereby the exhaust gases get an effective contact with the walls in the cavities. A number of measures can be taken in order to create an effective contact between exhaust gases and the coated, partitioning parts in the muffler. The muffler's casing parts can also be coated on the inside and in different ways come into contact with the exhaust gases. These and other characteristics and advantages of the invention will be more apparent in connection with the description of the preferred embodiments, and with full support of the drawing figures.

BRIEF DESCRIPTION OF THE DRAWING

The invention will be described in closer detail in the following by way of various embodiments thereof with reference to the accompanying drawing figures, in which the same numbers in the different figures state one another's corresponding parts.

DETAILED DESCRIPTION OF PREFERRED EMBODIMENT OF THE INVENTION

Figure 1:
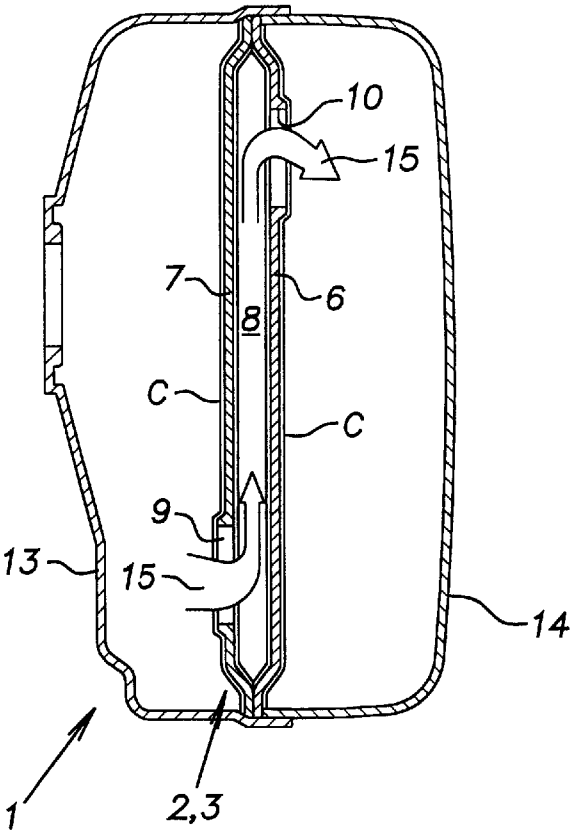
FIG. 1 shows a cross section of the muffler with catalytic converter, seen from the side, in accordance with the invention. It has a baffle. The cross section through the baffle follows line A—A in FIG. 2.

In the schematic FIG. 1 numeral reference 1 designates a catalytic muffler in accordance with the invention and 2 designates a partition, which is embodied in the muffler in the shape of a baffle 3. In this case, the muffler consists of a rear half 13, which is directly mounted to the combustion engine's exhaust port, and a front half 14. Both halves are attached by means of the rear half having a seam into which the front half fits. The baffle 3 is located between the two halves, so that it is firmly clamped between them. The halves can be detachably mounted to each other with for instance a screw, but they can also be firmly mounted through welding or soldering. The baffle 3 is designed with a basic part 6 and at least one covering plate 7, which covers a section of or the entire baffle. At least one of the basic part 6 or the covering plate 7 is profiled, so that at least one cavity 8 is formed between the basic part 6 and the covering plate 7. At least one aperture 9 connects the cavity 8 with the space upstream the baffle and at least one aperture 10 connects the cavity 8 with the space downstream the baffle. FIG. 1 clarifies how the exhaust gases 15 flow in through the aperture 9 and through the cavity 8 and out through the aperture 10. The baffle 3 is at least partly coated with a catalyzing layer C. Naturally, the entire baffle can be coated, but it is also possible that, for instance, only the surfaces which include the cavity 8 are coated with a catalyzing layer. It is above all these surfaces on the inside which come into contact with the exhaust gases. The cavity 8 is designed so that satisfactory contact is created between exhaust gases and walls coated with a catalyzing layer. This is apparent from FIGS. 2 and 3.

Figure 2:
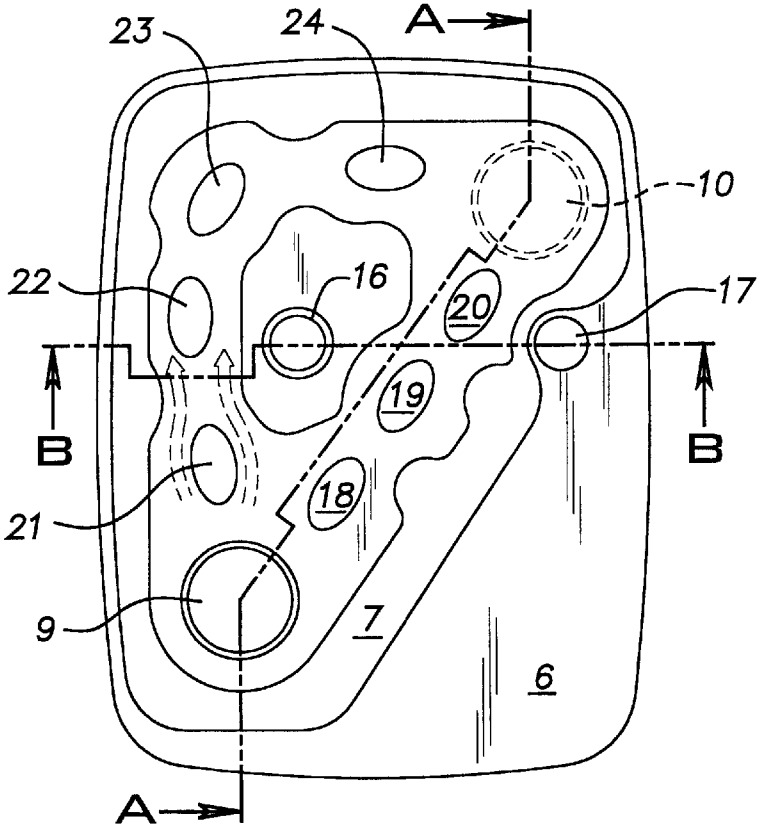
FIG. 2 shows the baffle 3 in FIG. 1 from the front, but somewhat enlarged.
Figure 3:
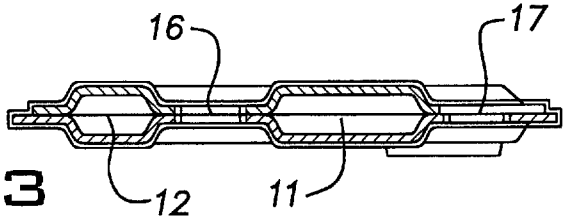
FIG. 3 shows a cross section along line B—B of the baffle in FIG. 2.

Thus, FIG. 2 shows the baffle 3 seen from the front. It consists of two profiled plates 6, 7, which have an interactive profiling, so that at least one cavity 8 is formed between them when they have been joined together. The two plates are in this case profiled in the same way, so that they each form half of the depth of the cavity 8. However, this can naturally vary within wide limits. One of the plates can for instance be completely plane and the other have the entire profiling. Furthermore, a number of smaller cover plates 7 can be used. Two holes 16 and 17 are made through the two plates. They are used for fastening the muffler with screws in a conventional way. The two plates 6, 7 are plane from their outer edges and inwards. In this case one of the plates is larger than the other, and the smaller plate does not quite extend to the edges. However, this can naturally vary, so that the two plates are of the same size. The cavity 8 is here created by means of the two plates being profiled out from each other. This profiling is made with curved sides in the flow direction in order to increase the turbulence in the exhaust gas flow. Furthermore, a number of islands 18–24 are embodied in the cavity 8. This also increases the turbulence in the flow as well as it creates an improved contact between the walls and the gas flow. The islands are created by means of local stampings in the plates so that these meet each other or almost reach each other. For the sake of clarity, the cross section A—A has been located beside the islands 18–20. As appears from FIGS. 2 and 3, the profiling is elongated so that two ducts 11, 12 are formed between the plates. In order to illustrate this principle the gas flow is shown in one 12 of the two ducts. Naturally, the baffle can be designed so that only one duct is formed or so that more ducts than two are formed. The basic desire is to create a satisfactory contact between exhaust gases and sidewalls in each duct respectively in order to enable a satisfactory exhaust gas conversion rate. Of course, several upstream apertures 9 can be used as well as several downstream apertures 10. The sides of the apertures can be collared as here or straight. By means of collaring, a somewhat improved contact can be created with the gas flow. As mentioned, FIG. 3 shows a cross section along line B—B. For the sake of clarity, the cross section has been located beside the islands 20, 22. Thus, these islands serve as obstacles in the gas flow and interacts with profilings in the outer sides of the cavity. This will be apparent by studying the gas flow, marked with broken lines, in FIG. 2.

Figure 4:
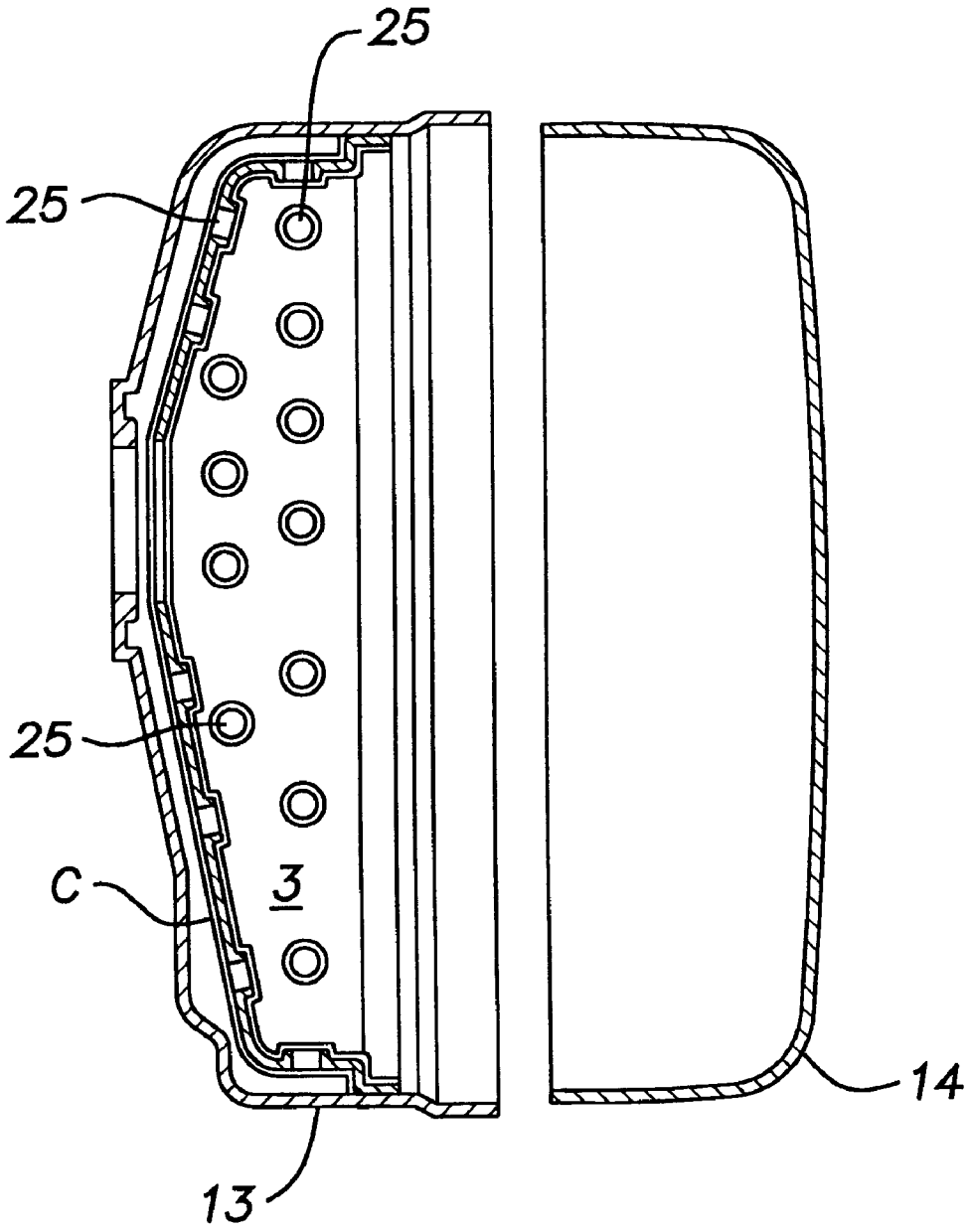
FIG. 4 shows another embodiment of the catalytic muffler in accordance with the invention, namely a partition in the shape of a baffle comprising one single plate, which closely follows the shape of one half of the muffler.

FIG. 4 shows a further design of a partitioning baffle 3. Just as in the previous design, the baffle is located in a divisible muffler housing consisting of a rear half 13 and a front half 14. These are similar to the halves in the previous design, but can also be identical. For the sake of clarity, the halves are shown in a partly exploded view. In this case, the baffle 3 consists of one single plate, and this is shaped in a way that it to a great extent follows the shape of the muffler's one half 13, 14 on the inside, so that a space of 1 to 20 mm is created between the baffle 3 and the muffler half 13. Thus, in this case the baffle is located in the rear muffler half 13, but it could also be located in the front half 14. A baffle can also be used in each half, as well as several baffles in each half. In the illustrated design the baffle 3 has no contact with the front half 14, but it could also be clamped between the halves in the same way as in the embodiment in FIG. 1. In the illustrated design, the baffle 3 can rest on a number of local stampings in the rear half 13 and be fixed by other local stampings. Naturally, it can also be fixed in other ways. In the illustrated design the baffle 3 closely follows the shape of the muffler's one half, in this case the rear one, so that a space of 1 to 10 mm is created between the baffle 3 and the muffler half 13. The space is on average approximately 6 mm and hereby a flow along the baffle's upstream side is created before the exhaust gases pass in through a number of small holes 25. By means of this flow a satisfactory contact is created between the baffle's upstream side and the exhaust gases. This is advantageous considering the exhaust gas conversion rate. Furthermore, it is advantageous using a number of small holes 25, which the exhaust gases pass in order to flow from one side of the partition to the other. The total surface area of the holes becomes large. Furthermore, the holes have been collared, so that the surface area of each hole has increased considerably. All of this lead to a more effective exhaust gas conversion rate. The entire baffle 3 is suitably coated with a catalyzing layer C. However, it is especially important that the upstream side and the holes are coated, since these have most contact with the exhaust gases. The holes can also be collared in the opposite direction. This would create a substantial turbulence on the upstream side of the baffle 3, which possibly could increase the conversion rate. Naturally, it is also possible to use non-collared holes and a greater or lesser number than those illustrated. This will to a certain extent influence the conversion rate. Naturally, the insides of the muffler halves 13 and 14 can also be coated with a catalyzing layer. In the illustrated design, this probably has the greatest effect in the case of the rear muffler half 13. However, by making an elaborate choice of the apertures' 25 size and preferably several collared holes, it is possible to create a number of exhaust gas jets, which hit the wall of the front muffler half 14, so that the exhaust gases get a satisfactory contact with the wall and consequently contributes to a satisfactory conversion rate.

Figure 5:
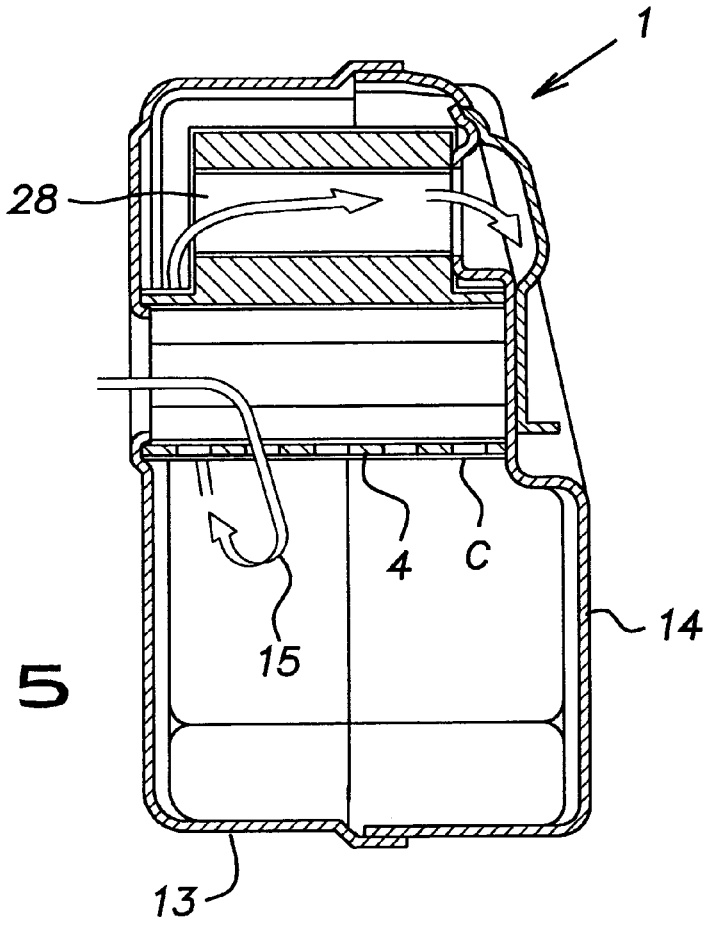
FIG. 5 shows an additional embodiment of the catalytic muffler in accordance with the invention. It is supplied with an integrated inlet tube and outlet tube, which each serves as partitions in the muffler.
Figure 6:
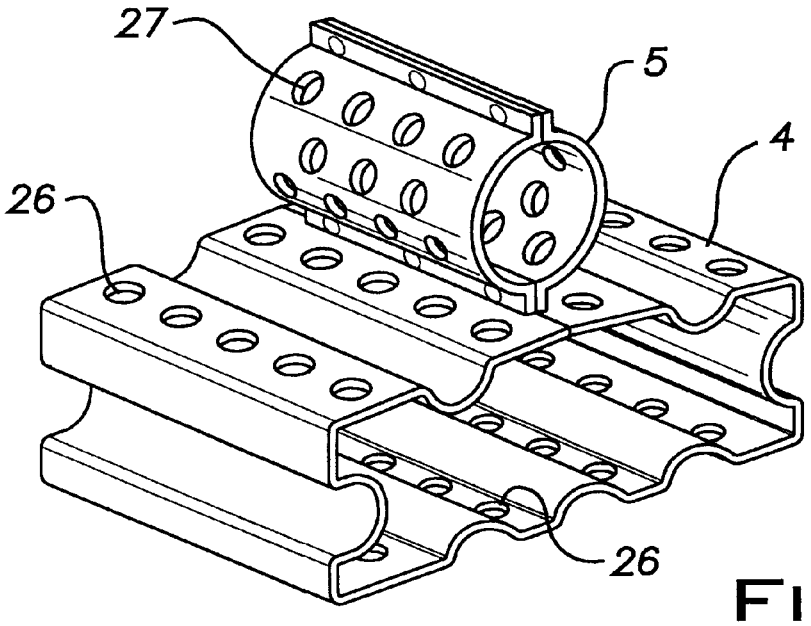
FIG. 6 shows in perspective the integrated inlet and outlet tube of the muffler in FIG. 5. The inlet tube is situated below the outlet tube.

FIGS. 5 and 6 shows another type of partition than those apparent from the previous embodiments. The exhaust gases 15 flow straight into an inlet tube 4. The inlet tube extends from one side of the muffler across to another side of it, in this case from the side which is connected to the engine's exhaust port and across to the opposite side. All communication out of the inlet tube 4 occurs by means of transverse apertures 26, seen in the inlet tube's axial direction. FIG. 6 shows in perspective the inlet tube 4 with apertures 26. Thus, the inlet tube 4 is open in both ends and these apertures are sealed by means of the inlet tube being clamped between the rear muffler half 13 and the front one 14. The inlet tube 4 surrounds the engine's exhaust port in the rear muffler half 13. The inlet tube has a profiled shape and is supplied with a number of apertures 26, through which the exhaust gases 15 flow out from the inlet tube. The profiling of the inlet tube can to a certain extent improve the exhaust gas conversion rate. The two indentations at the tube's two short sides are on the other hand mainly intended for creating space for two fastening screws, which extend straight through the muffler, and are intended for fastening it to the engine's cylinder. An outlet tube 5 is here integrated with the inlet tube 4, so that they form an assembled unit. This can for instance be punched from one single plate, which then is pressed so that it is given the desired appearance. Obviously, it can also consist of several units, which have been fastened together into an integrated or assembled unit. In the illustrated design, the outlet tube 5 partly has a large aperture at its end 28 and partly transverse apertures 27 seen in the outlet tube's axial direction. Thus, the exhaust gases 15 can flow partly into the outlet tube's 5 end and partly at its periphery through apertures 28 and 27 respectively. Naturally, it is also possible to equip the end of the outlet tube with a closure, so that all of the inflowing gases pass through the apertures 27. Furthermore, outlet tube 5 can be lacking entirely, so that only the inlet tube 4 is used or vice versa, i.e. so that only the outlet tube 5 is used and the inlet tube 4 is lacking. In this case the outlet tube extends from one side of the muffler across to another side of the muffler and all communication into the outlet tube 5 takes place by means of transverse apertures 27.

Figure 7:
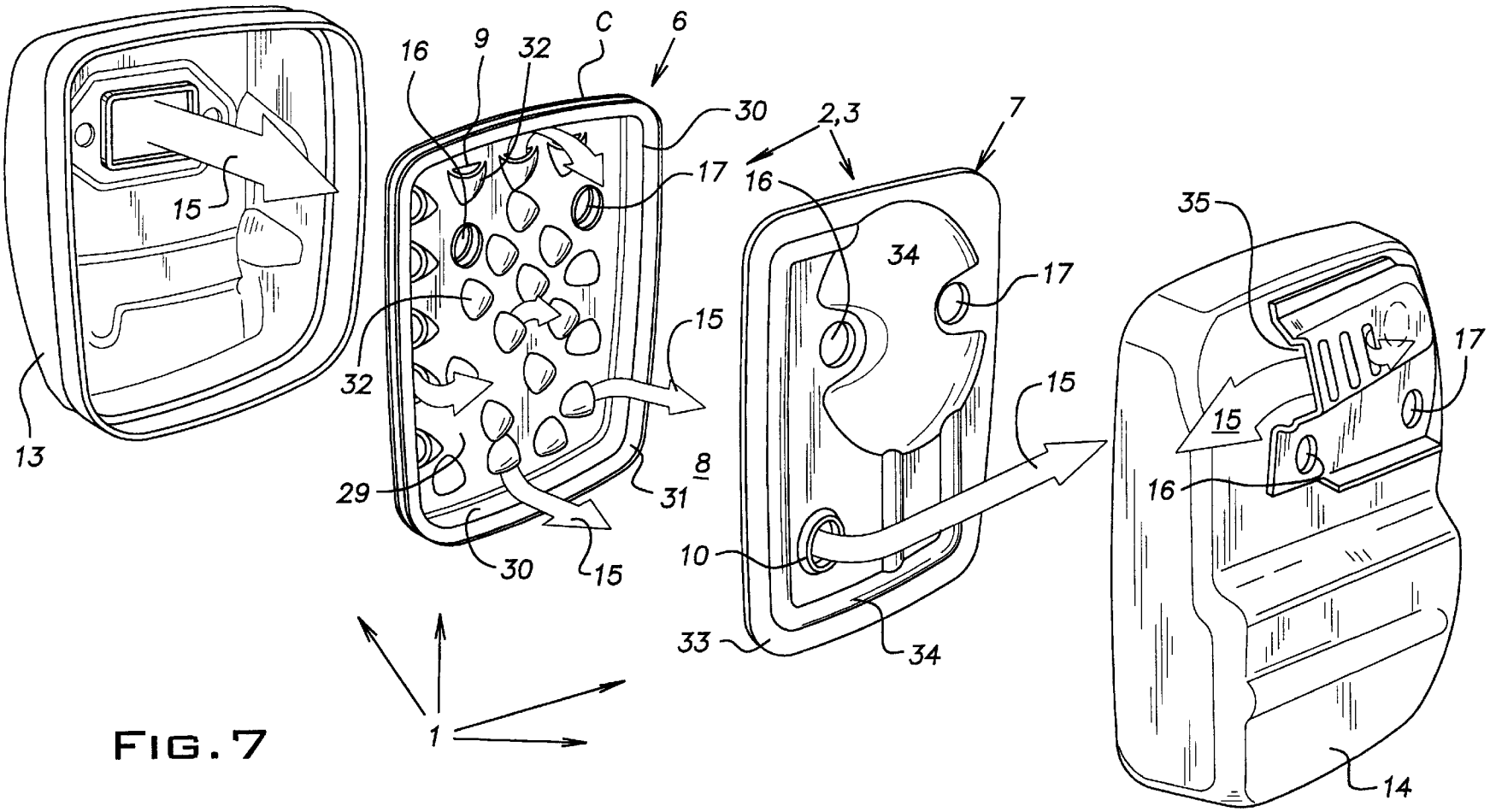
FIG. 7 shows in perspective an additional embodiment of the catalytic muffler in accordance with the invention. Most parts are shown in an exploded view to make the construction and function more clear.

FIG. 7 shows a further embodiment of the invention. The muffler's main parts are shown in an exploded view in order to make the flow inside the muffler more apparent. The embodiment has a number of similarities with the embodiment in accordance with FIGS. 1–3, but also shows a few differences. A partition or baffle 2, 3 is clamped between the housing parts 13, 14, exactly as in the previous embodiment. Two plate parts 6, 7 follow each other, seen in the flow direction of the exhaust gases. Part 6 is substantially profiled, while part 7 is relatively plane and only equipped with a few stiffening stampings 34. When the parts are joined together a cavity 8 is formed between part 6 and 7. For, part 6, which also can be called the basic part, has a depressed part 29, which is partitioned by surrounding edges 30. Furthest out there is a plane flange part 31. A number of apertures 9 are made in the depressed part 29. The apertures and the surrounding plate surface are designed so that they make the gas flow obliquely in relation to the plate part's surface. This is carried out by means of the aperture having been given a gill shape or similar. The plate part 6 is entirely or partly coated with a catalyzing layer C. The apertures' 9 gill shape is used in order to make the gas flow 15 out of the engine come into contact with the catalyzing layer of part 6 as effectively as possible. This takes place in a number of ways. Firstly, the surface area is large in each aperture 9 by means of the gill shape. Secondly, the gill shape directs the gas flow in a desirable direction. A number of gills are positioned around the depressed part's 29 outer periphery. These gills are turned towards the surrounding edges 30, so that the exhaust gases spray against these edges and are there redirected. Hereby they get a satisfactory contact with the catalyzing coating on the edges. The remaining gills have been turned in a diagonal direction, so that the exhaust gases spray in a direction away from the outlet hole 10 in the connecting plate 7. This contributes to an increase of the exhaust gases' 15 residence time in the cavity 8 between the plates 6 and 7. Thus, the aperture 10, which connects the cavity 8 with the space downstream the cavity, is located near one of the plate's 7 corners. Plate 7 can either be coated with a catalyzing layer or non-coated. The coating makes the plate considerably more expensive and in this case a non-coated plate has been chosen. Notice that through its presence the non-coated plate 7 makes sure that the exhaust gases come into contact with plate 6 to a greater extent than they would have done if plate 7 had been lacking. Thus, the non-coated plate 7 increases the usage of the plate 6. If an increased conversion rate is desired, it is suitable to locate an additional plate downstream plate 7 and let this plate be coated. It could be designed in much the same way as plate 6, but its profiling would then be turned away from plate 7, so that a cavity is formed between the downstream plate and plate 7. Apertures 9 shaped as gills, with the same orientation as for plate 6, is suitably used in order to create, in this case as well, as good a contact as possible between the exhaust gases 15 and the coated downstream plate. In this case the exhaust gases 15 are directed to an exhaust gas outlet 35 which is located in the outer muffler half 14. The exhaust gas outlet 35 is so designed that the greater amount of the exhaust gases flow across the muffler's outside, and certain amounts flow obliquely out through slits somewhat upstream the exhaust outlet 35. The holes 16, 17 which are embodied in the parts 6, 7 and 14 are used for fastening the muffler with screws in a conventional manner. In this case, the plate parts 6 and 7 consist of two separate plates, having the same width and height. For, plate 7 has a flange part 33 which comes into contact with the flange part 31 in the plate 6 when the plates are clamped together. One or several similar plates could in the same way be piled together in order to give a more effective exhaust gas conversion rate, as already mentioned. However, it is also possible that certain plate parts have reduced outer dimensions and are located inside the other plate parts, in order to avoid too many flange parts 31, 33 being piled on top of each other. Furthermore, several plate parts can be created by means of folding one plate once or several times, so that thereby one single plate can be shaped so that it functions as several plate parts following each other. Such a plate could for instance be immersed into an immersed part of another plate.

What is claimed is:

1. Muffler with catalytic converter (1) essentially arranged in direct connection with a combustion engine's exhaust port, said muffler with catalytic converter comprising a muffler housing forming a hollow interior space, and at least one partition (2) within the muffler housing which divides the interior space into an upstream space and a downstream space, wherein the partition is a metal plate defining a plurality of apertures through which exhaust gas flow passes in order to flow from the upstream space to the downstream space, and the metal plate is at least partly coated with a catalyzing layer, and wherein portions of the metal plate defining the apertures are coated with the catalyzing layer, and the apertures are spread over a majority of a surface area of the metal plate.

2. Muffler with catalytic converter in accordance with claim 1, wherein the baffle has several of the apertures.

3. Muffler with catalytic converter in accordance with claim 1, wherein the partition is entirely coated with the catalytic layer.

4. Muffler with catalytic converter in accordance with claim 1, wherein the aperture is collared.

5. Muffler with catalytic converter in accordance with claim 1, wherein the aperture is adapted to direct gas flow sideways.

6. Muffler with catalytic converter (1) essentially arranged in direct connection with a combustion engine's exhaust port, said muffler with catalytic converter comprising a muffler housing forming a hollow interior space, and at least one partition (2) within the muffler housing which divides the interior space into an upstream space and a downstream space, wherein the partition is a baffle (3) having at least one aperture (9, 10, 25, 26, 27, 28) through which exhaust gas flow passes in order to flow from the upstream space to the downstream space, a surface of the partition is at least partly coated with a catalyzing layer, said partition includes at least two plate parts (6, 7) following each other in the flow direction of exhaust gasses, at least one of the plate parts is profiled to form at least one cavity (8) between the plate parts (6, 7), and at least one aperture (9) connects the cavity (8) with the upstream space and at least one aperture (10) connects the cavity (8) with the downstream space.

7. Muffler with catalytic converter in accordance with claim 6, wherein at least one of the plate parts (6, 7) is at least partly coated with a catalyzer layer, and at least one of the plate parts (6, 7) is not coated with a catalyzer layer.

8. Muffler with catalytic converter in accordance with claim 6, wherein at least one of the plate parts (6, 7) is equipped with a number of apertures (9, 10) adapted to direct gas flow sideways.

9. Muffler with catalytic converter in accordance with claim 8, wherein the apertures adapted to direct gas flow sideways are gill shaped.

10. Muffler with catalytic converter (1) essentially arranged in direct connection with a combustion engine's exhaust port, said muffler with catalytic converter comprising a muffler housing forming a hollow interior space, and at least one partition (2) within the muffler housing which divides the interior space into an upstream space and a downstream space, wherein the partition is a baffle (3) having at least one aperture (9, 10, 25, 26, 27, 28) through which exhaust gas flow passes in order to flow from the upstream space to the downstream space, a surface of the partition is at least partly coated with a catalyzing layer, the partition (2) includes a basic part (6) and at least one covering plate (7) which covers at least a section of the basic part, at least one of the basic part (6) and the covering plate (7) is profiled so that at least one cavity (8) is formed between the basic part (6) and the covering plate (7), and at least one aperture (9) connects the cavity (8) with the upstream space and at least one aperture (10) connects the cavity (8) with the downstream space.

11. Muffler with catalytic converter in accordance with claim 10, wherein the profiling is elongated so that at least one duct (11, 12) is formed between the at least one aperture which connects the cavity with the upstream space and the at least one aperture which connects the cavity to the downstream space.

12. Muffler with catalytic converter in accordance with claim 11, wherein the profiling is elongated so that at least two ducts (11, 12) are formed between the at least one aperture which connects the cavity with the upstream space and the at least one aperture which connects the cavity to the downstream space.

13. Muffler with catalytic converter in accordance with claim 11, wherein the profiling is shaped to form a plurality of islands within the duct (11, 12) to increase turbulence of flow within the duct.

14. Muffler with catalytic converter (1) essentially arranged in direct connection with a combustion engine's exhaust port, said muffler with catalytic converter comprising a muffler housing forming a hollow interior space, and at least one partition (2) within the muffler housing which divides the interior space into an upstream space and a downstream space, wherein the partition is a baffle (3) having at least one aperture (9, 10, 25, 26, 27, 28) through which exhaust gas flow passes in order to flow from the upstream space to the downstream space, a surface of the partition is at least partly coated with a catalyzing layer, the muffler body has a front half and a rear half, the baffle (3) has a shape which mainly follows the shape of an interior surface of one of the front half and the rear half (13, 14) so that a space of 1 to 20 mm is created between the baffle (3) and the muffler body, and at least a portion of the partition with the catalyst layer forms the space such that gas within the space contacts the catalyst layer.

15. Muffler with catalytic converter in accordance with claim 7, wherein the baffle (3) has a shape which closely follows the shape of the interior surface of one of the front half and the rear half (13, 14) so that the space is 1 to 10 mm.

16. Muffler with catalytic converter essentially arranged in direct connection with a combustion engine's exhaust port, said muffler with catalytic converter comprising a muffler housing forming a hollow interior space, and at least one partition within said muffler housing including a metal plate forming an inlet tube (4), wherein all communication out of the inlet tube (4) takes place by means of transverse apertures (26), seen in the axial direction of the inlet tube, and the metal plate is at least partly coated with a catalyzing layer.

17. Muffler with catalytic converter in accordance with claim 16, wherein the partition is further in the form of an outlet tube (5).

18. Muffler with catalytic converter in accordance with claim 17, wherein the inlet tube (4) and the outlet tube (5) are integrated.

19. Muffler with catalytic converter in accordance with claim 18, wherein at least one of the inlet tube and the outlet tube extends from one side of the muffler housing across to the other side of the muffler housing.

20. Muffler with catalytic converter essentially arranged in direct connection with a combustion engine's exhaust port, said muffler with catalytic converter comprising a muffler housing forming a hollow interior space, and at least one partition within said muffler housing including a metal plate forming an outlet tube (5), wherein communication into the outlet tube (5) takes place at least partly by means of transverse apertures (27) in the outlet tube (5), seen in the axial direction of the outlet tube, and the metal plate is at least partly coated with a catalyzing layer.

* * * * *